US005822871A

United States Patent [19]

Walker

[11] Patent Number: 5,822,871

[45] Date of Patent: Oct. 20, 1998

[54] TOOL TO AID IN CUTTING CIRCLES IN DRYWALL

[76] Inventor: Douglas D. Walker, 6222 Glider Dr., San Jose, Calif. 95123

[21] Appl. No.: 745,961

[22] Filed: Nov. 7, 1996

[51] Int. Cl.[6] ..... B43L 9/04

[52] U.S. Cl. ..... 33/27.03

[58] Field of Search ..... 33/27.03, 566, 33/563, 564

[56] References Cited

U.S. PATENT DOCUMENTS

| | | | |
|---|---|---|---|
| 765,300 | 7/1904 | Williams | 33/27.03 |
| 844,157 | 2/1907 | Loughborough | 33/27.03 |
| 1,447,207 | 3/1923 | Golden | 33/27.03 |
| 2,542,537 | 2/1951 | Klemm | 33/27.03 |
| 3,474,538 | 10/1969 | Kirkegard | 33/27.03 |
| 4,173,829 | 11/1979 | Khait | 33/27.03 |
| 4,267,638 | 5/1981 | Heinz | 33/27.03 |
| 5,265,342 | 11/1993 | Lang, Jr. | 33/42 |
| 5,497,558 | 3/1996 | Wagner | 33/27.03 |
| 5,615,485 | 4/1997 | Stoneberg | 33/27.03 |

FOREIGN PATENT DOCUMENTS

| | | | |
|---|---|---|---|
| 558313 | 2/1957 | Italy | 33/27.03 |
| 342114 | 1/1931 | United Kingdom | 33/27.03 |

*Primary Examiner*—Thomas B. Will
*Attorney, Agent, or Firm*—The Kline Law Firm

[57] ABSTRACT

A tool that aids in the cutting of a circle in drywall. The tool consists chiefly of a substantially flat main body including a plurality of grooves. The grooves are used to guide a cutting tool (e.g. a drywall knife) in a circular path. A fixing pin is attached at a first end of the main body, and a second raised end of the main body is curved or angled upward so that the end of the tool does not become embedded in the drywall during the cutting operation. The raised end of the tool may also be used to push the tool on its circular path.

4 Claims, 3 Drawing Sheets

TOOL TO AID IN CUTTING CIRCLES IN DRYWALL

FIELD OF THE INVENTION

The present invention relates generally to construction hand tools, and more particularly is a tool to allow a user to accurately cut circles in drywall.

BACKGROUND OF THE INVENTION

Nearly every building built today uses drywall or sheetrock to cover its inner walls. Because the drywall is the last layer of material before the wall covering, many items must pass through the drywall, such as light fixtures, switches, electrical outlets, pipes, ducts, etc.

Therefore a builder often finds himself needing to cut an opening in a sheet of drywall. If the shape of the opening is rectangular, there is little difficulty involved in the job. However, when circular openings are required, the cutting is somewhat more difficult. Some builders simply cut the openings freehand, which may often suffice, but generally leads to an uneven and possibly improperly sized hole. There are very few devices available in the prior art to aid the builder in the task of cutting a round hole.

Builders who do not cut circles freehand generally use the prior art device shown in FIG. 1. This device has a pivot fixture 1 through which is slidably mounted a ruled bar 2. At the end of the ruled bar 2 there is fixed a block 3 with a rolling cutting wheel 4. The pivot fixture includes a sharp tip 5 that is embedded in the material to be cut. The bar 2 is fixed at the appropriate diameter, and the device is pivoted so that the cutting wheel 4 cuts a circle in the subject drywall.

Some of the shortcomings of this device are that it is fairly large and cumbersome. This makes it somewhat awkward to store and use. The ease of use of the device is further limited in that the prior art device, because of the two piece mechanism used to determine the cutting diameter, generally requires two hands to set the size of the hole to be cut. Since the device utilizes a cutting wheel which scores the drywall surface, after some time, the wheel becomes dull, and it cannot be replaced.

Accordingly, it is an object of the present invention to provide a circle cutting tool that is relatively small and is lightweight.

It is a further object of the present invention to provide a tool that is easily adjusted for cutting diameter.

It is a still further object of the present invention to allow the user to keep a sharp blade in use with the tool at all times.

SUMMARY OF THE INVENTION

The present invention is a tool that aids in the cutting of a circle in drywall. The tool consists chiefly of a substantially flat main body including a plurality of grooves. The grooves are used to guide a cutting tool (e.g. a drywall knife) in a circular path. A fixing pin is attached at a first end of the main body, and a second raised end of the main body is curved or angled upward so that the distal end of the tool does not become embedded in the drywall during the cutting operation. The raised end of the tool may also be used to push the tool on its circular path.

An advantage of the present invention is that because of its flat shape, it is easily stored and carried in a tool belt or the like.

Another advantage of the present invention is that it can cut many sizes of holes without any requirement of an adjustment of the tool.

A still further advantage of the present invention is that it is quite simple to use and manufacture, having no moving parts.

These and other objects and advantages of the present invention will become apparent to those skilled in the art in view of the description of the best presently known mode of carrying out the invention as described herein and as illustrated in the drawings.

DETAILED DESCRIPTION OF THE INVENTION

Figure 1:
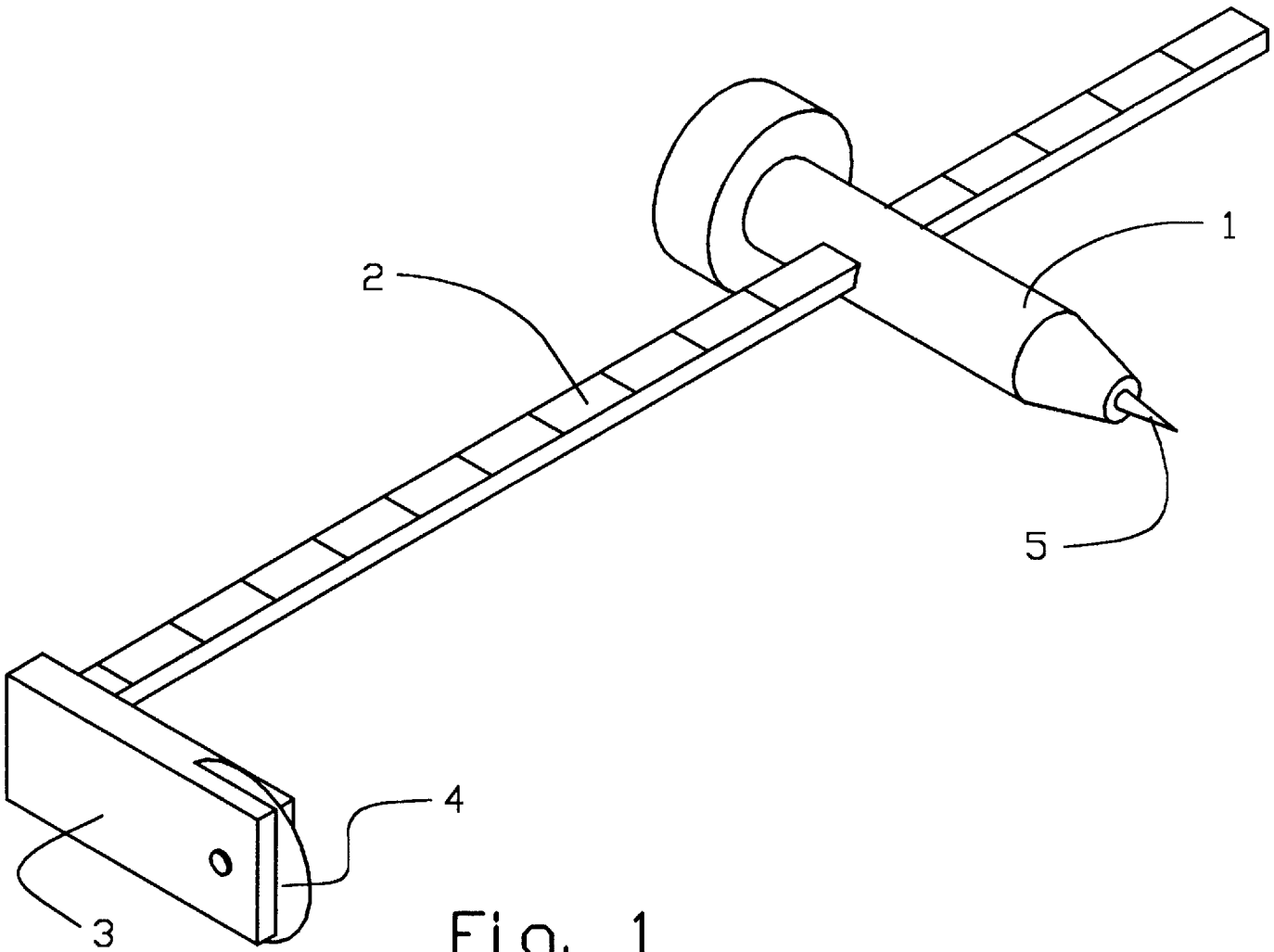
Fig. 1 (Prior Art)
FIG. 1 is a perspective view of a prior art circle cutting tool.
Figure 2:
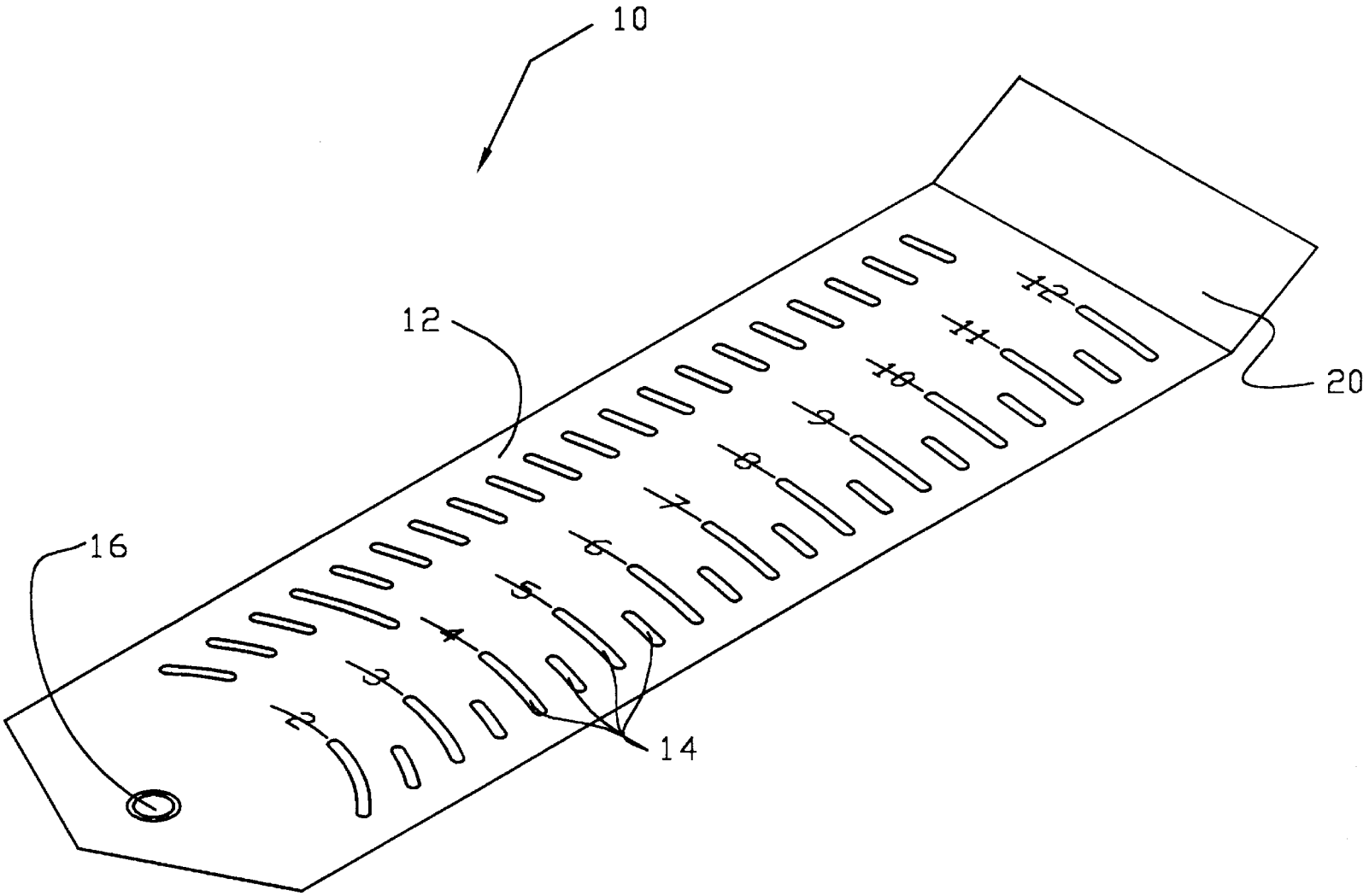
FIG. 2 is a top perspective view of the circle cutting tool of the present invention.
Figure 3:
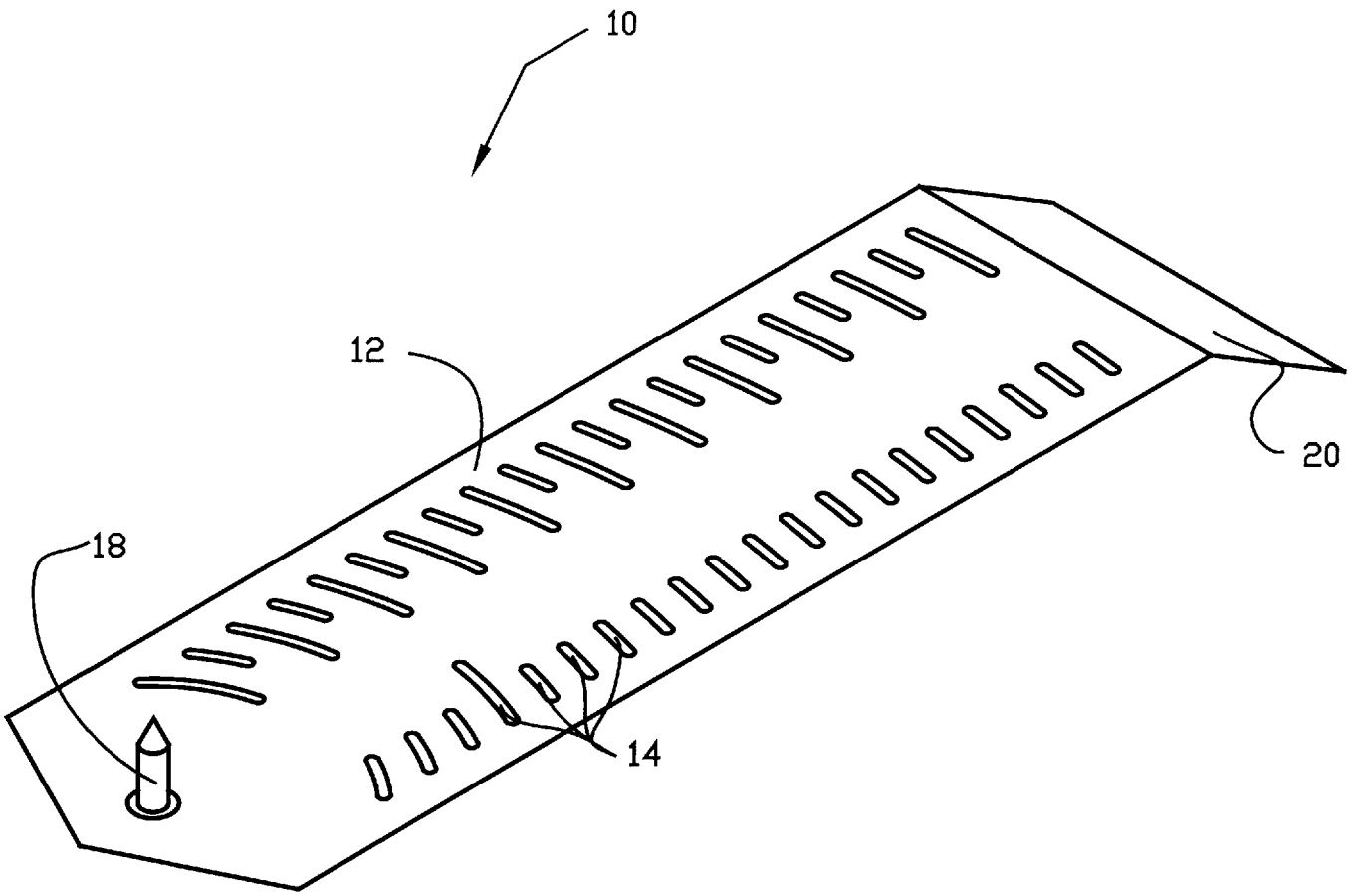
FIG. 3 is a bottom perspective view of the circle cutting tool of the present invention.

The present invention is a tool 10 that aids in the cutting of circles in drywall. The tool 10 comprises a substantially flat main body 12 including a plurality of grooves 14. The grooves 14 are adapted to guide a cutting tool (e.g. a drywall knife) in a circular path. Accordingly, the grooves 14 are in the form of arcs, and are concentric about a pivot point 16. The grooves 14 can be in any number and increment as chosen by the user. It is envisioned that in practice the tool will have grooves spaced in ⅛" increments, generating circles of ¼" increments, with a circle diameter range of up to 12".

On an underside of the main body, at a first end, there is a sharp projection that serves as a fixing pin 18. The fixing pin 18 anchors the device during a cutting operation. A second raised end 20 of the main body 12 may be curved or angled upward so that a distal end of the main body does not become embedded in the drywall that is being cut. The raised end 20 can also be used to push the tool 10 on its circular path.

Use of the circle cutting tool 10 is as follows: The user selects the point on a sheet of drywall that he wants to be the center point of a circular opening in the sheet. The user embeds the fixing point 18 in the chosen center point by pressing on the pivot point 16. He then chooses the appropriate groove 14 for the size hole he has chosen, and inserts his drywall knife through the selected groove into the sheet of drywall. The user then pushes the main body 12, utilizing the raised end 20, in a circle until he completes a 360° arc, thus cutting or scoring a circular opening in the drywall.

The above disclosure is not intended as limiting. Those skilled in the art will readily observe that numerous modifications and alterations of the device may be made while retaining the teachings of the invention. Accordingly, the above disclosure should be construed as limited only by the restrictions of the appended claims.

I claim:

1. A tool to aid in cutting circles in drywall comprising:

a substantially flat main body formed from a rigid material, a plurality of grooves adapted to guide a cutting tool, said grooves each include an inner wall and an outer wall, said inner walls and said outer walls of said grooves lie on arcs concentric to a pivot point at a first end of said main body, and a fixing pin situated at said pivot point of said first end of said main body on an underside thereof, said fixing pin is a sharp projection.

2. The tool of claim 1 wherein:

a second end of said main body extends upward such that a distal edge of said main body does not become embedded in a subject material during a cutting operation, said second end is adapted to be used to push said tool in a circular path.

3. The circle cutting tool of claim 1 wherein:

said grooves are spaced in one-eighth inch increments, each successive groove thereby generating a circle with a diameter one-quarter inch greater in size than the circle generated by a preceding groove.

4. The circle cutting tool of claim 2 wherein:

said grooves are spaced in one-eighth inch increments, each successive groove thereby generating a circle with a diameter one-quarter inch greater in size than the circle generated by a preceding groove.

* * * * *